US005780113A

United States Patent [19]

Masuda et al.

[11] Patent Number: 5,780,113

[45] Date of Patent: Jul. 14, 1998

[54] METHOD FOR FORMATION OF COATING FILM

[75] Inventors: Yutaka Masuda, Fujisawa; Akimasa Nakahata; Yoshiyuki Yukawa, both of Hiratsuka; Motoshi Yabuta, Hadano, all of Japan

[73] Assignee: Kansai Paint Co., Ltd., Japan

[21] Appl. No.: 833,118

[22] Filed: Apr. 4, 1997

[30] Foreign Application Priority Data

Apr. 5, 1996 [JP] Japan ..... 8-108686

[51] Int. Cl.[6] ..... B05D 5/06; B05D 7/14

[52] U.S. Cl. ..... 427/405; 427/409

[58] Field of Search ..... 427/409, 405

[56] References Cited

U.S. PATENT DOCUMENTS 4,971,841 11/1990 Panush et al. ..... 427/407.1

FOREIGN PATENT DOCUMENTS 49-014330 4/1974 Japan .
58-065768 4/1983 Japan .
58-065769 4/1983 Japan .

OTHER PUBLICATIONS

*WPI Abstracts*, Accession No. 93–365438/46 (abstract of JP 5–271580) (1992).

*WPI Abstracts*, Accession No. 91–027007/04 (abstract of JP 2–298384) (1989).

*Primary Examiner*—Erma Cameron

*Attorney, Agent, or Firm*—Wenderoth, Lind & Ponack, L.L.P.

[57] ABSTRACT

The present invention provides a method for forming a multi-layer coating film by applying a clear coating (B) on the film of a leafing type aluminum flake-containing metallic coating (A), which method comprises forming a film of the metallic coating (A), curing the film, applying thereon a composition (C) containing a polymer formed from an unsaturated monomer having a phosphoric acid group represented by —O—PO(OH)($R_1$) (wherein $R_1$ is a hydroxyl group, a phenyl group or a $C_{1-20}$ alkyl group) and a hydroxyl group-containing unsaturated monomer, and then applying the clear coating (B) on the film of the composition (C).

The method can form a multi-layer coating film improved in interlayer adhesivity between the metallic coating film and the clear coating film, without reducing the excellent effects and metallic feeling provided by a metallic coating film containing leafing type aluminum flake.

11 Claims, No Drawings

METHOD FOR FORMATION OF COATING FILM

The present invention relates to a method for formation of a multi-layer coating film comprising a leafing type aluminum flake-containing metallic film and a clear film, which multi-layer coating film has improved interlayer adhesivity.

A technique is known which comprises forming, on a substrate (e.g. a body panel of automobile), a multi-layer coating film by applying an aluminum flake-containing metallic coating on the substrate and then applying thereon a clear coating capable of forming a transparent film.

The aluminum flake pigment contained in a metallic coating is classified into a leafing type and a non-leafing type, depending upon the properties. The leafing type aluminum flake can easily form a continuous aluminum plane by floating onto the film of the metallic coating (this floating is called as leafing) and making substantially parallel orientation, and has unique properties of giving a coating film surface of high density, strong brightness and flip-flop feeling and chrome plating-like finish. However, when a clear coating is applied, on a wet-on-wet basis, onto the uncured film of a metallic coating containing leafing type aluminum flake, the orientation of aluminum flake becomes irregular inviting deterioration of chrome plating-like finish (this deterioration is called mottling after clear coat); when a clear coating is applied onto the cured film of a metallic coating containing leafing type aluminum flake, the interlayer adhesivity between the metallic coating film and the clear coating film is not sufficient; thus, in any of the above cases, it has been impossible to fully utilize the above-mentioned properties of leafing type aluminum flake. Meanwhile, non-leafing type aluminum flake is dispersed in a metallic coating film without causing leafing. Therefore, when a clear coating is applied onto the film of a metallic coating containing non-leafing type aluminum flake, there occurs no reduction in interlayer adhesivity, metallic feeling or the like unlike the above case where a clear coating is applied onto the film of a metallic coating containing leafing type aluminum flake; however, it is difficult to obtain a metallic coating film of strong brightness and flip-flop feeling and excellent chrome plating-like finish.

In view of the above situation, the present inventors made a study on improvement of the interlayer adhesivity between (1) the film of a metallic coating containing leafing type aluminum flake and (2) the film of a clear coating, without reduction in the above-mentioned properties (e.g. high density, strong brightness and flip-flop feeling and chrome plating-like finish) and metallic feeling possessed by the metallic coating film (1). As a result, the present inventors found out that the above improvement is made possible by curing the metallic coating film (1), applying thereon a composition comprising a particular polymer, i.e. a phosphoric acid group- and hydroxyl group-containing polymer and then applying a clear coating to form the clear coating film (2). The present invention has been completed based on the finding.

According to the present invention, there is provided a method for forming a multi-layer coating film by applying a clear coating (B) on the film of a leafing type aluminum flake-containing metallic coating (A), which method comprises forming a film of the metallic coating (A), curing the film, applying thereon a composition (C) containing a polymer formed from an unsaturated monomer having a phosphoric acid group represented by —O—PO(OH)($R_1$) (wherein $R_1$ is a hydroxyl group, a phenyl group or a $C_{1-20}$ alkyl group) and a hydroxyl group-containing unsaturated monomer, and then applying the clear coating (B) on the film of the composition (C).

The metallic coating (A) used in the method of the present invention for formation of a multi-layer coating film (the method is hereinafter referred to as the present method) is usually a liquid coating comprising a vehicle component and a leafing type aluminum flake metallic pigment.

The vehicle component can be a per se known vehicle for metallic coating, for example, a vehicle comprising a resin having a crosslinkable functional group (e.g. a hydroxyl group) and a crosslinking agent. The crosslinkable functional group-containing resin includes an acrylic resin, a polyester resin, an alkyd resin, etc. all having two or more hydroxyl groups in the molecule. Of these resins, a hydroxyl group-containing acrylic resin is particularly preferred. Suitable as the crosslinking agent is a melamine resin reactive with said crosslinkable functional group. A preferable specific example thereof is a partially or fully etherified melamine resin having 1–5 triazine rings, obtained by etherifying part or the whole of the methylol groups of methylolmelamine with a monohydric alcohol having 1–8 carbon atoms. An imino group-containing melamine resin or a blocked or unblocked polyisocyanate compound can also be used as the crosslinking agent. The appropriate amount ratio of the crosslinkable functional group-containing resin and the crosslinking agent used is such that the former is 50–90% by weight, particularly 60–80% by weight based on the total of the solid contents of the two components and the latter is 50–10% by weight, particularly 40–20% by weight.

The leafing type aluminum flake pigment used in the metallic coating (A) is preferably an aluminum flake produced by milling aluminum mechanically using an auxiliary agent (e.g. stearic acid). It appropriately has a lengthwise direction size of 2–50 μm and a thickness of 0.1–2 μm. The metallic coating (A) containing such a leafing type aluminum flake metallic pigment can form a metallic coating film having a high density, strong brightness and flip-flop feeling and chrome plating-like finish.

The metallic coating (A) can be produced by dissolving or dispersing the above components in an organic solvent. The metallic coating (A) can further comprise, as necessary, a coloring pigment, an extender pigment, an antisettling agent, an ultraviolet absorber, a catalyst, etc.

The metallic coating (A) can be applied, by electrostatic coating, spray coating or the like, onto a substrate (e.g. a body panel of automobile) obtained by applying a primer (e.g. a cationic electrocoating) onto a metallic or a plastic sheet, curing the resulting primer film, as necessary applying an intermediate coating, and as necessary curing the resulting intermediate coating film. Application of the metallic coating (A) without curing of the intermediate coating film and subsequent simultaneous curing of the intermediate coating film and the metallic coating (A) film is effective because it can shorten the application step. The appropriate thickness of the metallic coating (A) film is generally 1–20 μm, particularly 14–18 μm as cured. The metallic coating (A) film can be cured by heating it at a temperature of about 100°–180° C. for about 10–40 minutes.

The feature of the present method is to apply, onto the cured film of the metallic coating (A), a composition (C) containing a polymer formed from an unsaturated monomer having a phosphoric acid group represented by —O—PO(OH)($R_1$) (wherein $R_1$ is a hydroxyl group, a phenyl group or a $C_{1-20}$ alkyl group) and a hydroxyl group-containing unsaturated monomer (the polymer is hereinafter referred to as P-polymer), and then apply a clear coating (B) on the film of the composition (C).

The phosphoric acid group-containing unsaturated monomer used in production of the P-polymer contained in the composition (C), is a compound having, in the molecule, a phosphoric acid group represented by the following formula:

$$—OPO(OH)(R_1)$$

(wherein $R_1$ is a hydroxyl group, a phenyl group or an alkyl group having 1–20, particularly 2–10 carbon atoms) and a polymerizable unsaturated bond. The monomer includes, for example, acid-phosphoxy-$C_{1-20}$ alkyl (meth)acrylates such as acid-phosphoxyethyl acrylate, acid-phosphoxyethyl methacrylate, acid-phosphoxypropyl acrylate, acid-phosphoxypropyl methacrylate and the like; and equimolar adducts between glycidyl (meth)acrylate and mono-$C_{1-20}$ alkyl phosphate. An acid-phosphoxy-$C_{2-10}$ alkyl (meth) acrylate is particularly preferred. The hydroxyl group-containing unsaturated monomer is a compound having, in the molecule, a hydroxyl group and a polymerizable unsaturated bond. The monomer includes, for example, $C_{2-20}$, particularly $C_{2-10}$ hydroxyalkyl (meth)acrylates such as hydroxyethyl (meth)acrylate, hydroxypropyl (meth) acrylate, hydroxybutyl (meth)acrylate and the like. The hydroxyl group-containing unsaturated monomer further includes PLACCELs FA-1, FA-2, FA-3, FA-4, FA-5, FM-1, FM-2, FM-3, FM-4, FM-5 and FM-6 (trade names and products of Daicel Chemical Industries, Ltd.), which are each an ester of the above-mentioned hydroxyalkyl (meth) acrylate and caprolactone.

The P-polymer can be produced by copolymerizing the phosphoric acid group-containing unsaturated monomer, the hydroxyl group-containing unsaturated monomer and, as necessary, an N-alkoxymethylamide group-containing unsaturated monomer and/or other unsaturated monomer.

The N-alkoxymethylamide group-containing unsaturated monomer is a compound having an N-alkoxymethylamide group and a polymerizable unsaturated bond in the molecule. It includes, for example, N—$C_{1-6}$ alkoxymethyl (meth)acrylamides such as N-methoxymethyl(meth) acrylamide, N-ethoxymethyl(meth)acrylamide, N-butoxymethyl(meth)acrylamide, N-propoxymethyl(meth) acrylamide and the like. The other unsaturated monomer includes, for example, $C_{1-22}$ alkyl (meth)acrylates such as methyl (meth)acrylate, ethyl (meth)acrylayte, propyl (meth) acrylate, butyl (meth)acrylate and the like; vinyl aromatic compounds such as styrene, vinyltoluene and the like; vinyl monomers such as acrylonitrile, vinyl acetate, vinyl chloride and the like; olefins such as ethylene, propylene and the like; and carboxyl group-containing unsaturated compounds such as (meth)acrylic acid, maleic acid, maleic anhydride and the like.

In the P-polymer, the preferable amount ratio of the phosphoric acid group-containing monomer and the hydroxyl group-containing monomer is generally such that the former is 1–50% by weight, particularly 5–30% by weight based on the total monomers constituting the P-polymer and the latter is 1–50% by weight, particularly 5–30% by weight based on the total monomers constituting the P-polymer. The appropriate amounts of the N-alkoxymethylamide group-containing unsaturated monomer is generally 30% by weight or less, particularly 1–20% by weight based on the total monomers constituting the P-polymer. The remainder is the other unsaturated monomer. The copolymerization of these monomers is preferably conducted by solution polymerization. The resulting P-polymer preferably has a hydroxyl value of generally 5–150 mg KOH/g, particularly 10–120 mg KOH/g, more particularly 30–110 mg KOH/g; an acid value based on the phosphoric acid group, of generally 10–150 mg KOH/g, particularly 20–130 mg KOH/g; and a number-average molecular weight of 1,000–100,000, particularly 3,000–50,000, more particularly 5,000–30,000.

A P-polymer free from any N-alkoxymethylamide group-containing monomer unit has no self-crosslink-ability or self-curability but, when used in combination with an N-alkoxymethylamide group-containing monomer, can be subjected to crosslinking. When in the composition (C), a P-polymer free from any N-alkoxymethylamide group-containing monomer unit is used in combination with a polymer having N-alkoxymethylamide group-containing monomer units, the composition has crosslinkability.

The composition (C) can be produced by dissolving or dispersing, in an organic solvent, the P-polymer and, optionally, the N-alkoxymethylamide group-containing monomer or a polymer containing units of the monomer. In this case, it is possible to add a melamine resin, etc. as necessary. The composition (C) appropriately has a solid content of generally about 5–80% by weight, particularly about 10–60% by weight when applied.

According to the present method, the composition (C) is applied, before the clear coating (B) is applied, onto the cured film of the metallic coating (A) formed on a substrate (e.g. a body panel of automobile). (The substrate is obtained by applying a primer on a metal or plastic sheet and then applying, as necessary, an intermediate coating thereon.) The composition (C) can be applied by a per se known method such as electrostatic coating, spray coating or the like so as to give a coating film having an "as cured" thickness of generally about 0.1–5μ, preferably about 0.2–4μ, more preferably about 0.3–3μ. The coating film is allowed to stand at room temperature for about 1–20 minutes or is cured at a temperature of about 80°–180° C., after which the clear coating (B) is applied.

The clear coating (B) is a coating capable of forming a clear film and is appropriately a per se known organic solvent type thermosetting coating containing a base material resin and a crosslinking agent. The base material resin used in the clear coating (B) includes, for example, an acrylic resin, a polyester resin, an alkyd resin, a fluororesin and a silicon-containing resin, all having a crosslinkable functional group such as hydroxyl group, epoxy group, carboxyl group, silanol group or the like. The crosslinking agent includes, for example, a melamine resin, a urea resin, a blocked or unblocked isocyanate compound, an epoxy compound or resin, a carboxyl group-containing compound or resin, an acid anhydride and an alkoxysilane group-containing compound or resin, all having a group reactive with the above-mentioned functional group of the base material resin.

The clear coating (B) can be produced by dissolving or dispersing the above-mentioned two components in an organic solvent. As necessary, the clear coating may further comprise a coloring pigment, a metallic pigment, an ultraviolet absorber, etc. in such amounts that the transparency of the resulting coating film is not impaired. The clear coating (B) can have a solid content of generally about 30–80% by weight when applied.

The clear coating (B) is applied onto the cured or uncured film of the composition (C) formed on the cured film of the metallic coating (A), by a per se known method such as electrostatic coating, spray coating or the like so as to give a coating film having an "as-cured" thickness of generally 20–80μ, preferably 30–50μ, and then is cured with heating. The appropriate curing temperature is generally 100°–160° C.

As described above, in the present method for formation of a multi-layer coating film, the composition (C) is applied, before the application of the clear coating (B), on a metallic coating film having, on the surface, a continuous aluminum plane formed by parallel orientation of leafing type aluminum flake, whereby a multi-layer coating film significantly improved in interlayer adhesivity between the clear coating film and the metallic coating film can be formed without any deterioration in the effects provided by leafing type aluminum flake, i.e. the film surface of high density, strong brightness and flip-flop feeling and chrome plating-like finish.

Such a multi-layer coating film has good heat insulation as compared with other coating films. Therefore, in an automobile coated with the present method, the inside temperature is less affected by atmospheric conditions.

The present invention is described more specifically below by way of Examples.

1. Production of samples

1) Material to be coated

Onto a zinc phosphate-treated dull-finish steel plate (thickness: 0.8 mm) was applied a thermosetting epoxy resin type cationic electrocoating (Elecron 9600 (trade name), a product of Kansai Paint Co., Ltd.) so as to form a film of about 20μ in thickness as cured; the film was cured at 170° C. for 30 minutes; thereonto was applied, by air spraying, an intermediate coating for automobile (an organic solvent type coating containing, as bases, a thermosetting polyester resin and a melamine resin) (TP-37 Primer.Surfacer (trade name), a product of Kansai Paint Co., Ltd.)) so as to form a film of about 25μ in thickness as cured; and the resulting material was allowed to stand at room temperature for 3 minutes. The thus-obtained material was used as a material to be coated.

2) Metallic coatings (A)

(A-1)

In a mixed organic solvent (xylene/toluene=1/1 by weight) were dispersed or dissolved 65 parts by weight of a polyester resin (*1), 35 parts by weight of a melamine resin (*2) and 10 parts by weight of a leafing type aluminum flake (*3); and the mixture was subjected to viscosity adjustment so as to have a viscosity of 13 seconds as measured by Ford Cup No. 4 (20° C.).

*1: A polyester resin of phthalic anhydride-hexahydrophthalic anhydride type, having a number-average molecular weight of about 3,500, a hydroxyl value of 82 mg KOH/g and an acid value of 8 mg KOH/g.

*2: UBAN 28-60 (trade name), a product of Mitsui Toatsu Chemicals, Inc.

*3: Hi Print 60T (trade name), a product of Toyo Aluminum K.K. having a lengthwise direction size of 4.4 μm and a thickness of 0.2 μm.

(A-2) (for comparison)

In a mixed organic solvent (xylene/toluene=1/1 by weight) were dispersed or dissolved 65 parts by weight of a polyester resin (*1), 35 parts by weight of a melamine resin (*2) and 10 parts by weight of a non-leafing type aluminum flake (*4); and the mixture was subjected to viscosity adjustment so as to have a viscosity of 13 seconds as measured by Ford Cup No. 4 (20° C.).

*4: ALUMIPASTE 7640 NS (trade name), a product of Toyo Aluminum K.K. having a lengthwise direction size of 17 μm and a thickness of 0.5 μm.

3) Compositions (C)

(C-1)

A composition having a solid content of 50% by weight was produced by mixing, into an organic solvent (xylene), a phosphoric acid group- and hydroxyl group-containing resin (acid value based on phosphoric acid: 63 mg KOH/g, hydroxyl value: 60 mg KOH/g, number-average molecular weight: 11,500) obtained by polymerizing, in a mixed solvent (xylene/butanol=1/1 by weight), 15 parts by weight of acid-phosphoxyethyl methacrylate, 14 parts by weight of 2-hydroxyethyl methacrylate, 20 parts by weight of methyl methacrylate, 21 parts by weight of butyl methacrylate and 30 parts by weight of 2-ethylhexyl methacrylate.

(C-2)

A composition having a solid content of 50% by weight was produced by mixing, into an organic solvent (xylene), a phosphoric acid group- and hydroxyl group-containing resin (acid value based on phosphoric acid: 126 mg KOH/g, hydroxyl value: 72 mg KOH/g, number-average molecular weight: 13,000) obtained by polymerizing, in a mixed solvent (xylene/butanol=1/1 by weight), 30 parts by weight of acid-phosphoxyethyl methacrylate, 15 parts by weight of 2-hydroxyethyl acrylate, 20 parts by weight of methyl methacrylate, 5 parts by weight of butyl methacrylate and 30 parts by weight of 2-ethylhexyl methacrylate.

(C-3)

A composition having a solid content of 50% by weight was produced by mixing, into an organic solvent (xylene), a phosphoric acid group-, hydroxyl group- and alkoxymethylamide group-containing resin (acid value based on phosphoric acid: 21 mg KOH/g, hydroxyl value: 72 mg KOH/g, number-average molecular weight: 11,000) obtained by polymerizing, in a mixed solvent (xylene/butanol=1/1 by weight), 5 parts by weight of acid-phosphoxyethyl methacrylate, 15 parts by weight of 2-hydroxyethyl methacrylate, 15 parts by weight of N-butoxymethylacrylamide, 20 parts by weight of styrene, 15 parts by weight of butyl methacrylate and 30 parts by weight of 2-ethylhexyl methacrylate.

(C-4) (for comparison)

A composition having a solid content of 50% by weight was produced by mixing, into an organic solvent (xylene), a butoxymethylacrylamide group-containing resin (number-average molecular weight: 11,500) obtained by polymerizing, in butyl cellosolve, 20 parts by weight of N-butoxymethylacrylamide, 20 parts by weight of styrene, 30 parts by weight of butyl methacrylate and 30 parts by weight of 2-ethylhexyl methacrylate.

4) Clear coatings (B)

(B-1)

In a hydrocarbon type solvent (SWASOL 1000 (trade name), a product of Cosmo Oil Co., Ltd.) were dispersed or dissolved 50 parts by weight of a carboxyl group-containing acrylic resin (*5), 50 parts by weight of an epoxy group-containing acrylic resin (*6), 1 part by weight of an ultraviolet absorber (TINUBIN 900 (trade name), a product of Ciba-Geigy), 2 parts by weight of a 1/1 (in equivalent) mixture of tetrabutylammonium bromide and monobutyl phosphate, and 0.1 part by weight of a surface conditioner (BYK 300 (trade name), a product of BYK Chemie). The resulting mixture was subjected to viscosity adjustment so as to have a viscosity of 25 seconds as measured by Ford Cup No. 4 at 20° C.

*5: A polymer composed of 20% by weight of methanol half ester of maleic anhydride, 20% by weight of 4-hydroxy-n-butyl acrylate, 40% by weight of n-butyl acrylate and 20% by weight of styrene, which has a number-average molecular weight of 3,500, an acid value of 86 mg KOH/g and a hydroxyl value of 78 mg KOH/g.

*6: A polymer composed of 30% by weight of glycidyl methacrylate, 20% by weight of 4-hydroxy-n-butyl acrylate, 30% by weight of n-butyl acrylate and 20% by weight of styrene, which has a number-average molecular weight of 3,000, an epoxy group content of 2.12 mM/g and a hydroxyl value of 78 mg KOH/g.

(B-2)

In a hydrocarbon type solvent (SWASOL 1000 (trade name), a product of Cosmo Oil Co., Ltd.) were dispersed or dissolved 60 parts by weight of a carboxyl group-containing acrylic resin (*7), 40 parts by weight of an epoxy group-containing acrylic resin (*6), 1 part by weight of an ultraviolet absorber (TINUBIN 900 (trade name), a product of Ciba-Geigy), 2 parts by weight of a 1/1 (in equivalent) mixture of tetrabutylammonium bromide and monobutyl phosphate, and 0.1 part by weight of a surface conditioner (BYK 300 (trade name), a product of BYK Chemie). The resulting mixture was subjected to viscosity adjustment so as to have a viscosity of 25 seconds as measured by Ford Cup No. 4 at 20° C.

*7: A polymer composed of 20% by weight of methanol half ester of maleic anhydride, 16% by weight of 2-hydroxyethyl acrylate, 44% by weight of n-butyl acrylate and 20% by weight of styrene, which has a number-average molecular weight of 3,500, an acid value of 86 mg KOH/g and a hydroxyl value of 78 mg KOH/g.

2. Examples and Comparative Examples

Onto the uncured intermediate coating film of the above-mentioned material to be coated was applied the metallic coating (A-1) or (A-2) so as to form a film thereof having a thickness of 15 μm as cured, and the resulting material was allowed to stand at room temperature for 5 minutes. Then, the material was heated at 140° C. for 30 minutes to cure the intermediate coating film and the metallic coating film. Onto the metallic coating film was applied one of the compositions (C-1) to (C-4) so as to form a film thereof having a thickness of 1–2 μm as cured, and the resulting material was allowed to stand at room temperature for 5 minutes. Onto the composition film was applied the clear coating (B-1) or (B-2) so as to form a film thereof having a thickness of 40 μm as cured, and the resulting material was allowed to stand at room temperature for 5 minutes. Then, the material was heated at 140° C. for 30 minutes to cure the composition film and the clear coating film.

Each of the thus-obtained multi-layer coating films was measured for properties. The results are shown in Table 1.

TABLE 1

| | Examples | | | | Comparative Examples | | | |
|---|---|---|---|---|---|---|---|---|
| | 1 | 2 | 3 | 4 | 1[1] | 2 | 3 | 4 |
| Metallic coating (A) | (A-1) | (A-1) | (A-1) | (A-1) | (A-1) | (A-2) | (A-1) | (A-1) |
| Composition (C) | (C-1) | (C-2) | (C-3) | (C-1) | (C-1) | (C-1) | (C-4) | - |
| Clear coating (B) | (B-1) | (B-1) | (B-1) | (B-2) | (B-1) | (B-1) | (B-1) | (B-1) |
| Properties of multilayer coating film | | | | | | | | |
| Adhesivity[2] | ○ | ○ | ○ | ○ | ○ | ○ | × | × |
| IV[3] | 246 | 245 | 244 | 248 | 71 | 200 | 245 | 246 |
| FF[4] | 1.7 | 1.7 | 1.7 | 1.7 | 0.7 | 1.2 | 1.7 | 1.7 |
| Appearance[5] | ○ | ○ | ○ | ○ | × | × | ○ | ○ |

Notes for Table 1

[1]In Comparative Example 1, the composition (C-1) was applied without curing the film of the metallic coating (A-1).

[2]Adhesivity was tested by (a) producing cutlines in the multi-layer coating film with a cutter so that the cutter edge reached the dull-finish steel plate, to form 100 squares each of 2 mm × 2 mm, (b) adhering a pressure-sensitive adhesive tape on the multi-layer coating film, (c) peeling the tape quickly, and (d) examining the extent of removal of coating film squares. ○ refers to no peeling (no removal) of any coating film square and ×refers to peeling of 10 or more coating film squares.

[3]IV refers to a Y value at a highlight of 15° as measured by use of a goniophotometer [MA 68, a product of X-Rite].

[4]FF refers to a value obtained by applying a Y value "a" at 15° and a Y value "b" at 45°, both measured in the same manner as in the above (3), to the following formula: FF (a − b)/[(a + b)/2]

TABLE 1-continued

| | Examples | | | | Comparative Examples | | | |
|---|---|---|---|---|---|---|---|---|
| | 1 | 2 | 3 | 4 | 1[1] | 2 | 3 | 4 |

[5]In "appearance", ○ refers to chrome plating-like finish, and × refers to ordinary silver metallic finish or generation of mottling by strike in.

What is claimed is:

1. A method for forming a multi-layer coating film by applying a clear coating (B) on a film of a leafing aluminum flake-containing metallic coating (A), which method comprises forming a film of the metallic coating (A), curing the film, applying thereon a composition (C) containing a polymer formed from an unsaturated monomer having a phosphoric acid group represented by —O—PO(OH)($R_1$) (wherein $R_1$ is a hydroxyl group, a phenyl group or a $C_{1-20}$ alkyl group) and a hydroxyl group-containing unsaturated monomer, and then applying the clear coating (B) on a film of the composition (C).

2. The method according to claim 1, wherein the phosphoric acid group-containing unsaturated monomer is selected from the group consisting of an acid-phosphoxy-$C_{1-20}$ alkyl (meth)acrylate and an equimolar adduct of glycidyl (meth)acrylate and a mono-$C_{1-20}$ alkyl phosphate.

3. The method according to claim 2, wherein the phosphoric acid group-containing unsaturated monomer is an acid-phosphoxy-$C_{2-10}$ alkyl (meth)acrylate.

4. The method according to claim 1, wherein the hydroxyl group-containing unsaturated monomer is a $C_{2-20}$ hydroxyalkyl ester of (meth)acrylic acid.

5. The method according to claim 4, wherein the hydroxyl group-containing unsaturated monomer is a $C_{2-10}$ hydroxyalkyl ester of (meth)acrylic acid.

6. The method according to claim 1, wherein the polymer is obtained by copolymerizing the phosphoric acid group-containing unsaturated monomer, the hydroxyl group-containing unsaturated monomer and, optionally, an unsaturated monomer selected from an N-alkoxymethylamide group-containing unsaturated monomer and other unsaturated monomer.

7. The method according to claim 1, wherein the polymer has a hydroxyl value of 5–150 mg KOH/g.

8. The method according to claim 1, wherein the polymer has an acid value based on the phosphoric acid group, of 10–150 mg KOH/g.

9. The method according to claim 1, wherein the polymer has a number-average molecular weight of 1,000–100,000.

10. The method according to claim 1, wherein the film of the composition (C) has a thickness of 0.1–5 μm as cured.

11. The method according to claim 1, wherein the film of the leafing aluminum flake-containing metallic coating (A) is formed by applying a primer on a substrate, heat-curing the resulting primer film, optionally applying an intermediate coating and optionally heating the resulting intermediate coating film, and applying the metallic coating (A) thereon.

* * * * *